US007883080B2

(12) United States Patent
Hoehle

(10) Patent No.: US 7,883,080 B2
(45) Date of Patent: Feb. 8, 2011

(54) PRINTED COPY COLLECTING APPARATUS

(75) Inventor: Karl-Heinz Hoehle, Plauen (DE)

(73) Assignee: Man Roland Druckmaschinen AG, Augsburg (DE)

( * ) Notice: Subject to any disclaimer, the term of this patent is extended or adjusted under 35 U.S.C. 154(b) by 599 days.

(21) Appl. No.: 11/934,483

(22) Filed: Nov. 2, 2007

(65) Prior Publication Data

US 2008/0288112 A1 Nov. 20, 2008

(30) Foreign Application Priority Data

Nov. 2, 2006 (DE) ..... 10 2006 051 569

(51) Int. Cl.
*B41F 13/62* (2006.01)

(52) U.S. Cl. ..... 270/47; 270/38; 270/42; 270/50; 270/7; 270/15; 493/425; 493/423

(58) Field of Classification Search ..... 270/6, 270/7, 13, 14, 15, 19, 38, 42, 47, 48, 49, 270/50; 493/423, 424, 425
See application file for complete search history.

(56) References Cited

U.S. PATENT DOCUMENTS 4,380,449 A * 4/1983 Michalik ..... 493/424
5,201,701 A * 4/1993 Roettger et al. ..... 493/425
2004/0221749 A1* 11/2004 Fujinuma et al. ..... 100/327

FOREIGN PATENT DOCUMENTS

| | | | |
|---|---|---|---|
| DE | 38 10 439 | C1 | 8/1989 |
| DE | 40 17 645 | C2 | 1/1991 |
| DE | 44 08 202 | C2 | 9/1995 |
| DE | 196 25 084 | C2 | 1/1998 |
| DE | 10 2004 020 303 | A1 | 11/2005 |
| DE | 10 2004 020 304 | A1 | 11/2005 |
| EP | 1 069 063 | A2 | 1/2001 |
| EP | 1 475 336 | A1 | 11/2004 |
| GB | 2287243 | A * | 9/1995 |

* cited by examiner

*Primary Examiner*—Patrick Mackey
(74) *Attorney, Agent, or Firm*—Crowell & Moring LLP

(57) ABSTRACT

An apparatus and method for collecting a printed copy is disclosed. A collecting cylinder is operable in a non-collect mode and a collect mode. A cam collect is coupled to the collecting cylinder. The collecting cylinder is switchable between the non-collect mode and the collect mode by a relative rotational movement between the collecting cylinder and the cam collect.

5 Claims, 2 Drawing Sheets

PRINTED COPY COLLECTING APPARATUS

This application claims the priority of German Patent Document No. 10 2006 051 569.2, filed Nov. 2, 2006, the disclosure of which is expressly incorporated by reference herein.

BACKGROUND AND SUMMARY OF THE INVENTION

The invention relates to a collecting cylinder of a folding unit of a printing press and method for operating the same.

Folding units of printing presses are used to form folds in printed substrates, wherein for fold formation, a web-shaped printing substrate is normally first fed through a so-called former in order to form a longitudinal fold on the web-shaped and not yet severed printing substrate. Starting from the former, the web-shaped printing substrate is transported over several draw rollers in the direction of a cutting knife cylinder, whereby copies are severed on the cutting knife cylinder by cross-cutting the web-shaped printing substrate. The copies severed from the web-shaped printing substrate at the cutting knife cylinder are held or carried over by a cylinder cooperating with the cutting knife cylinder, whereby holding devices of this cylinder are designed either as pins or as grippers for the copies being separated from the printing substrate. The cylinder cooperating with the cutting knife cylinder is consequently formed as a function of this either as a pin cylinder or a gripper cylinder. If cross-folds are supposed to be formed on the severed copies, tucker blades are integrated into the pin cylinders or gripper cylinders, which, when the cross-folds are being formed in the copies, also press them between folding jaws of a folding jaw cylinder that is cooperating with the pin cylinder or gripper cylinder. If no cross-folds are supposed to be formed in the copies, no tucker blades are integrated into the pin cylinders or gripper cylinders. The copies severed from the web-shaped printing substrate and provided with cross-folds, as the case may be, can be provided in the area of a folding table with a second longitudinal fold, which runs parallel to the longitudinal fold formed in the former.

The pin cylinder or gripper cylinder cooperating with the cutting knife cylinder can be formed as a so-called collecting cylinder in order to provide the folding apparatus with a collecting function. These types of collecting cylinders make it possible to stack several copies in the area of the collecting cylinder and thus to collect them. Special control of the holding devices and the movement of the tucker blades of the collecting cylinder is required in collect mode as well as in non-collect mode and, as the case may be, of the tucker blades of the collecting cylinder, whereby opening and closing of the holding devices in collect mode is controlled via at least one control cam and at least one cam collect of the collecting cylinder. In non-collect mode, opening and closing of the holding devices and the movement of the tucker blades is controlled exclusively by the control cams.

A collecting cylinder of a folding unit of a printing press is known from German Patent Document DE 38 10 439 C1. Thus, in addition to at least one control cam, the collecting cylinder is comprised of at least one cam collect. In order to transfer the collecting cylinder according to DE 38 10 439 C1 between collect mode and non-collect mode and back, the, or each, cam collect is drivable via a hollow pinion positioned so that it is axially displaceable on a shaft embodied as a worm, whereby the collecting cylinder can be transferred or switched between collecting mode and non-collecting mode and back by axial displacement of the hollow pinion. This type of structural design for the collecting cylinder requires a relatively large construction.

Starting herefrom, the present invention is based on the objective of creating a new type of collecting cylinder of a folding unit of a printing press.

According to the invention, the cylinder body of the collecting cylinder along with the, or each, control cam is positioned via a first bearing body on a frame, wherein the, or each, cam collect is positioned via a second bearing body coxially to the first bearing body on an axis of the collecting cylinder, wherein a speed difference between the, or each, cam collect and the collecting cylinder can be made available via transmission gearing having several gears and a shiftable unique coupling, and wherein, to switch the collecting cylinder between non-collect mode and collect mode and back with an opened unique coupling, an exclusive relative rotation between the, or each, cam collect and the collecting cylinder around a specific angle can be realized in such a way that the unique coupling is also rotatable around this angle.

In the case of the collecting cylinder in accordance with the invention, the transfer between non-collect mode and collect mode and back takes place exclusively via a relative movement between the, or each, cam collect and the collecting cylinder.

In contrast to the prior art according to DE 38 10 439 C1, when transferring the collecting cylinder between non-collect mode and collect mode and back, there is no axial movement of the components of the cylinder, so that the inventive collecting cylinder has a smaller structural shape as compared with the prior art. In addition, the inventive design of a collecting cylinder is structurally simpler and therefore more cost-effective.

Preferred developments of the invention are yielded from the following description. Without being limited hereto, exemplary embodiments of the invention are explained in greater detail on the basis of the drawings.

DETAILED DESCRIPTION OF THE DRAWINGS

Figure 1:
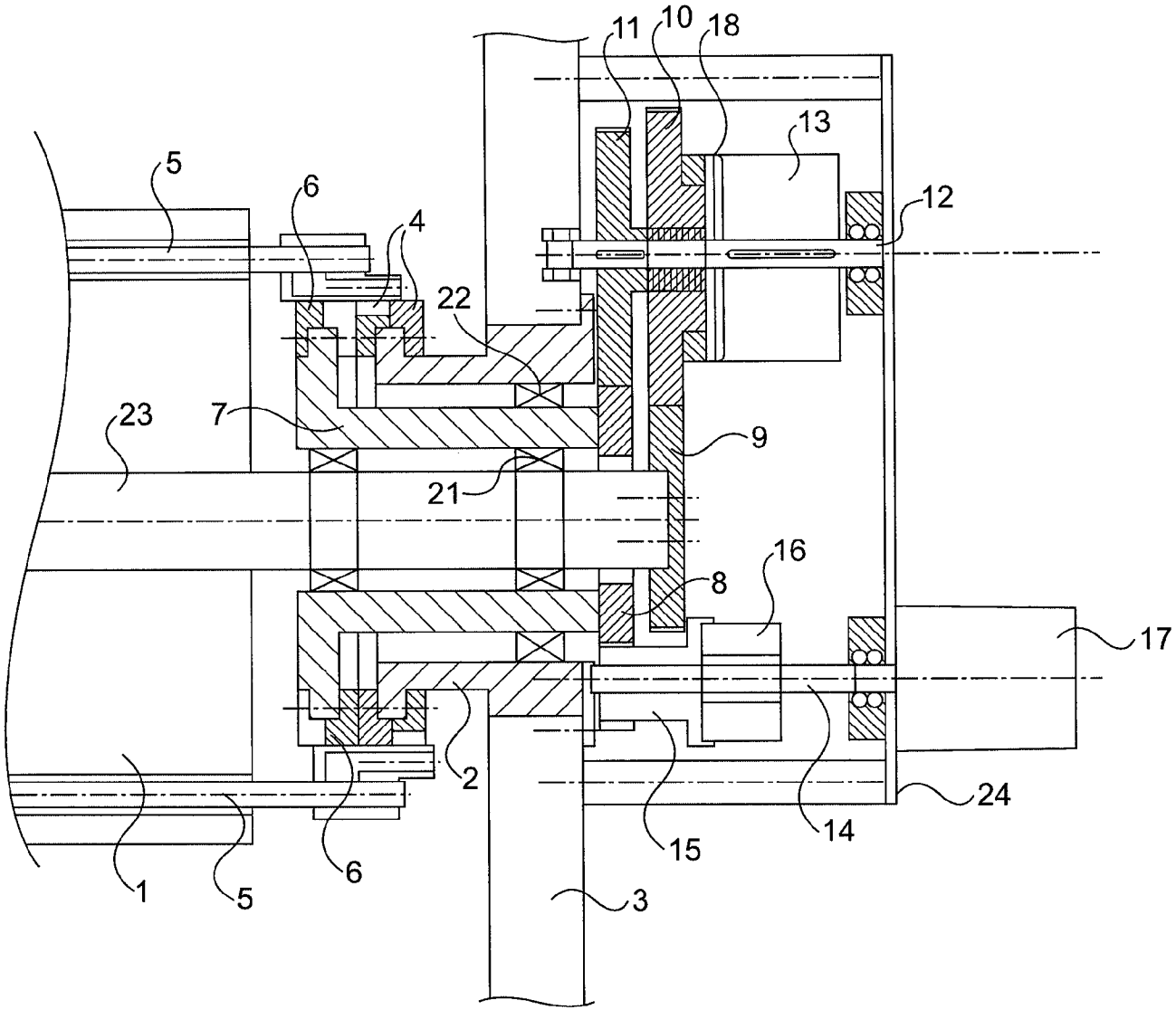
FIG. 1 is a schematic representation of an inventive collecting cylinder of a folding unit of a printing press according to a first exemplary embodiment.
Figure 2:
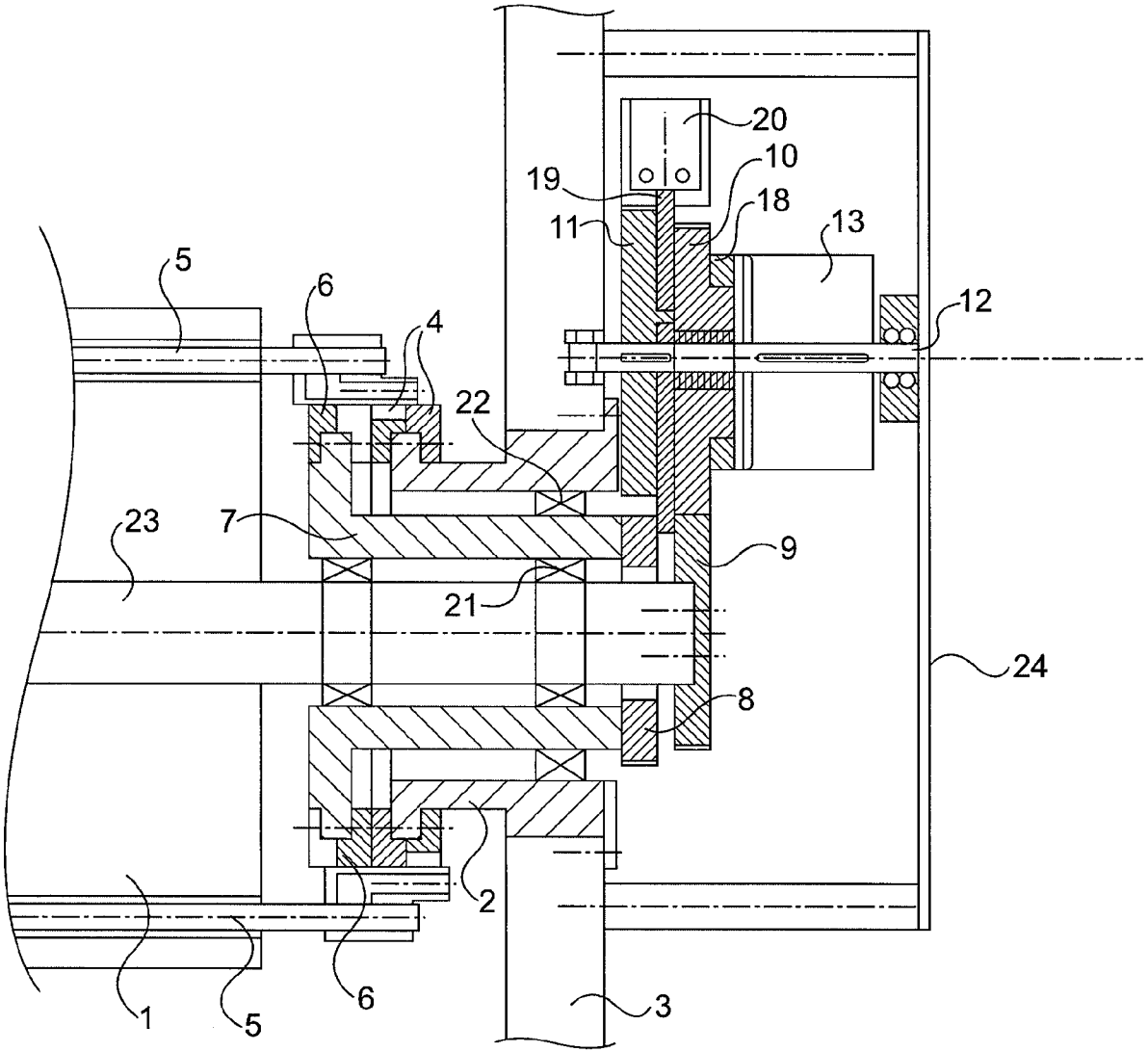
FIG. 2 is a schematic representation of an inventive collecting cylinder of a folding unit of a printing press according to a second exemplary embodiment.

The present invention will be described in greater detail in the following making reference to FIGS. 1 and 2, whereby FIGS. 1 and 2 show two different exemplary embodiments of an inventive collecting cylinder of a folding unit of a printing press.

FIG. 1 shows sections of a cross-section of a collecting cylinder according to a first exemplary embodiment of the invention, wherein the collecting cylinder in FIG. 1 has a cylinder body 1, which is positioned via a bearing body 2 on a frame 3 of a folding apparatus. Moreover, acting on this bearing body 2 are control cams 4, which can be used to actuate holding devices that are fastened to shafts 5 and allocated to the cylinder body 1 when the collecting cylinder is in non-collect mode. The holding devices are preferably embodied as pins or grippers.

When the collecting cylinder is in collect mode, these control cams 4 cooperate with cam collects 6, which are allocated to a second bearing body 7. The second bearing body 7 extends coxially towards the first bearing body 2 and is rotatably mounted via bearings 21 on an axis 23 of the collecting cylinder. In addition, the second bearing body 7 is rotatably mounted via bearings 22 with respect to the first bearing body 2, wherein, according to FIG. 1, the second bearing body 7 encloses a section of the axis 23 of the collecting cylinder and the first bearing body 2 encloses the second bearing body 7 in sections.

As already stated, the collecting cylinder's holding devices that are fastened to the shafts 5 and allocated to the cylinder body 1 are actuated in non-collect mode exclusively by the control cams 4, and in collect mode by both the control cams 4 and the cam collects 6, whereby then a defined differential speed is required between the collecting cylinder and the cam collects 6. This differential speed is made available via transmission gearing having several gears 8, 9, 10 and 11. According to FIG. 1, the gears 8 and 9 are allocated to the axis 23 of the collecting cylinder, and the gears 10 and 11, on the other hand, are allocated to a shaft 12 running axially parallel to the axis 23, to which shaft a shiftable unique coupling 13 is also allocated. The gears 8 and 11 mesh with one another and form a first gear pair and gears 9 and 10 also mesh with one another and form a second gear pair. The first gear pair formed by gears 8 and 11 has a transmission ratio of 1 to 1. The second gear pair formed by gears 9 and 10, on the other hand, has, a transmission ratio, which can provide the differential speed required in collect mode between the collecting cylinder and the cam collects 6 of the collecting cylinder.

According to FIG. 1, the gear 8 of the first cylinder pair is rotatably mounted on the axis 23 of the collecting cylinder. On the other hand, the gear 11 of the first cylinder pair is fixed on the shaft 12. The gear 9 of the second cylinder pair is fixed on the shaft 23 of the collecting cylinder. In principle, the gear 10 of the second cylinder pair is mounted on the shaft 12 so that it can freely rotate, but it can be fixed on the shaft via the unique coupling 13. The first cylinder pair's gear 8 that is allocated to the axis 23 is thus embodied as a so-called idler gear, which can be rotated with respect to the axis 23. The shaft 12, which supports the gears 10 and 11, is rotatably mounted in a frame 3, on the one hand, and in an auxiliary frame 24 on the other. Power transmission between the gears 10 and 11 can be made available or interrupted via the unique coupling 13 allocated to the shaft 12.

Then, when the power transmission between the two gears 10 and 11 is made available via the unique coupling 13, both gears 10 and 11 rotate at the same speed along with the shaft 12. Then, on the other hand, when the unique coupling 13 interrupts the power transmission between the gears 10 and 11, the gear 10 can be rotated independent of gear 11 as well as the shaft 12 within the sense of an idler gear.

To switch the collecting cylinder depicted in FIG. 1 between collect mode and non-collect mode and back, when the unique coupling 13 is opened, an exclusive relative movement between the cam collects 6 and the collecting cylinder around a specific angle can be realized, wherein the unique coupling 13 can also be rotated around this angle.

As already stated, when the unique coupling 13 is opened, the coupling interrupts the power transmission between the gears 10 and 11 allocated to the shaft 12 so that, when a main drive of the folding apparatus is at a standstill, a separate drive 17 can rotate the cam collects 6 with respect to the collecting cylinder. To this end, the separate drive 17 drives, via a gear 15 positioned on another shaft 14 running axially parallel to the axis 23 of the collecting cylinder as well as via a locked freewheeling clutch 16 allocated to the same shaft 14, into the gear 8 of the first cylinder pair, thereby rotating the second bearing body 7, which is firmly connected to the gear 8. Since, as already mentioned, the cam collects 6 act on this second bearing body 7, the cam collects 6 are hereby rotated relative to the collecting cylinder. Since the gear 8 is engaged with gear 11 and the transmission ratio between the gears 8 and 11 is 1 to 1, during the rotation of the cam collects 6 around a defined angle, the unique coupling 13 is also rotated around this defined angle. The gears 9 and 10, on the other hand, are at a standstill when the unique coupling is opened. The gear 15 is connected to the freewheeling clutch 16 so that it is torque-resistant. The drive 17 is connected to the shaft 14 so that it is torque-resistant.

The unique coupling 13 has several switch points at its disposal, which are respectively offset from one another by a defined angle. Closing the unique coupling 13 is then only possible if corresponding coupling discs of the unique coupling 13 were rotated towards one another around the respective angle. FIG. 1 shows a coupling disc 18 that is allocated to the gear 10. In the case of a collecting cylinder that is three sections long and a transmission ratio between the cam collects 6 and the control cams 4 of ¾, a switchover angle from the collect mode to the non-collect mode is 45° and from non-collect mode to collect mode is 135°. Therefore, four switch points can be realized for the unique coupling 13.

In the case of the collecting cylinder 1 in accordance with the invention, switching between a collect run and a non-collect run and back, is thus accomplished exclusively via a relative rotation between the cam collects 6 and the collecting cylinder. No axial movement of components of the collecting cylinder is required during this switch. The coaxial positioning of the bearing body 7 supporting the cam collects 6 and of the bearing body 2 supporting the control cams 4 results in a splitting of the bearing speeds, whereby the bearing 21 between the axis 23 of the collecting cylinder and the bearing body 7 is subject to the differential speed between the speed of the cam collects 6 and the collecting cylinder, and whereby the bearing 22 between the two bearing bodies 2, 7 is subject to the speed of the cam collects 6.

In the exemplary embodiment shown in FIG. 1, switching the collecting cylinder between collect mode and non-collect mode is accomplished via a separate drive 17, which, when the unique coupling 13 is opened, rotates the cam collects 6 as well as the part of the transmission gearing that is separated from the main drive of the folding drive by the unique coupling 13 around a defined angle via a freewheeling clutch 16 and a gear 15 connected in a torque-resistant manner to the locked freewheeling clutch 16, thereby also rotating the unique coupling 13 around this angle.

FIG. 2 shows another exemplary embodiment of an inventive collecting cylinder of a folding unit of a printing press, whereby the principle structure of the collecting cylinder in FIG. 2 corresponds to the exemplary embodiment in FIG. 1. In order to avoid unnecessary repetitions, the same reference numerals are used for the same components. In the following, only the details of the exemplary embodiment in FIG. 2 that vary from those in the exemplary embodiment in FIG. 1 will be discussed.

In the exemplary embodiment in FIG. 2, a separate drive is not required to make the relative movement between the cam collects 6 and the collecting cylinder available, so that components 14, 15, 16 and 17 are eliminated in the exemplary embodiment in FIG. 2.

In fact, in the exemplary embodiment in FIG. 2, the exclusive relative movement between the cam collects 6 and the collecting cylinder is made available by the fact that a brake disc 19 cooperating with a brake 20 is allocated to the gear 11 of the first gear pair, and that the brake 20 is closed in order to switch the collecting cylinder between non-collect mode and collect mode and back with an opened unique coupling 13 and therefore with interrupted power transmission between the gears 10 and 11. In the case of an opened unique coupling 13 and a closed brake 20, the gears 11 and 8 of the first gear pair stand still when the main drive of the folding apparatus is rotating at a relatively low speed. Because of this, the cam collects 6 allocated to the second bearing body 7 also stand still since the bearing body 7 is firmly connected to the gear 8 of the first gear pair. In contrast, however, in the case of an opened unique coupling 13 and closed brake 20, the collecting cylinder can be rotated with respect to the cam collects 6, wherein the unique coupling 13 is also rotated.

In order to hereby guarantee an equal angle rotation of the cam collect 6 and unique coupling 13, in the exemplary embodiment in FIG. 2, the transmission ratio between the meshing gears 9 and 10 of the second gear pairs is 1 to 1, whereas the transmission ratio between gears 8 and 11 of the first gear pair makes available the speed difference between the collecting cylinder and the cam collects 6 that is required in collect mode.

After the collecting cylinder has been switched between collect mode and non-collect mode or back between non-collect mode and collect mode, the unique coupling 13 is closed and the brake 20 opens. The advantage of the exemplary embodiment in FIG. 2 as compared with the exemplary embodiment in FIG. 1 is that the exemplary embodiment in FIG. 2 does not require a separate drive to guarantee the relative rotation between the cam collects 6 and the collecting cylinder.

LIST OF REFERENCE NUMERALS

1 Cylinder body
2 Bearing body
3 Frame
4 Control cam
5 Shaft
6 Cam collect
7 Bearing body
8 Gear
9 Gear
10 Gear
11 Gear
12 Shaft
13 Unique coupling
14 Shaft
15 Gear
16 Freewheeling clutch
17 Drive
18 Coupling disc
19 Brake disc
20 Brake
21 Bearing
22 Bearing
23 Axis
24 Auxiliary frame The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A printed copy collecting apparatus, comprising:
a cylinder body and a control cam coupled to a first bearing body;
a cam collect coupled to a second bearing body;
a transmission gearing, wherein the transmission gearing includes:
a first meshing gear pair;
a second meshing gear pair; and
a shiftable coupling;
wherein a respective first gear of the two gear pairs is allocated to a shaft of the cylinder body, a respective second gear of the two gear pairs is allocated to a first shaft that runs axially parallel to the shaft of the cylinder body, and the shiftable coupling is operable to interrupt a power transmission between the gears that are allocated to the first shaft; and
a drive coupled to a second shaft running axially parallel to the shaft the cylinder body, wherein the second shaft includes a freewheeling clutch and a gear connected to the first gear pair's gear that is allocated to the shaft of the cylinder body, which first gear pair's gear that is allocated to the shaft of the cylinder body is mounted so that it is freely rotatable on the shaft and is firmly connected to the second bearing body.

2. The printed copy collecting apparatus according to claim 1, wherein the second bearing body is rotatably mounted on the shaft of the cylinder body via bearings and coaxially via bearings on the first bearing body, wherein the first bearing body encloses the second bearing body in sections and the second bearing body encloses the shaft in sections.

3. The printed copy collecting apparatus according to claim 2, wherein the drive rotates the first gear pair's gear that is allocated to the first shaft, which gear is fixed on the first shaft.

4. A printed copy collecting apparatus, comprising:
a cylinder body and a control cam coupled to a first bearing body;
a cam collect coupled to a second bearing body;
a transmission gearing, wherein the transmission gearing includes:
a first meshing gear pair;
a second meshing gear pair; and
a shiftable coupling;
wherein a respective first gear of the two gear pairs is allocated to a shaft of the cylinder body, a respective second gear of the two gear pairs is allocated to a first shaft that runs axially parallel to the shaft of the cylinder body, and the shiftable coupling is openable to interrupt a power transmission between the gears that are allocated to the first shaft; and
a brake which cooperates with a brake disc that is coupled to the first gear pair's gear that is allocated to the first shaft;
wherein when the shiftable coupling is opened and when the brake is closed, the second bearing body and the cam collect are stationary and the cylinder body is rotatable relative to the cam collect.

5. The printed copy collecting apparatus according to claim 4, wherein the second bearing body is rotatably mounted on the shaft of the cylinder body via bearings and coaxially via bearings on the first bearing body, wherein the first bearing body encloses the second bearing body in sections and the second bearing body encloses the shaft in sections.

* * * * *